US006056105A

United States Patent [19]

Ohtomo

[11] Patent Number: 6,056,105

[45] Date of Patent: May 2, 2000

[54] DEVICE AND METHOD FOR DISCRIMINATING A CIRCULAR PLATE BODY SUCH AS A COIN

[75] Inventor: Hiroshi Ohtomo, Iwatuki, Japan

[73] Assignee: Asahi Seiko Co., Ltd., Tokyo, Japan

[21] Appl. No.: 09/083,648

[22] Filed: May 21, 1998

[51] Int. Cl.[7] ..... G07D 5/08

[52] U.S. Cl. ..... 194/319

[58] Field of Search ..... 194/317, 318, 194/319

[56] References Cited

U.S. PATENT DOCUMENTS

| | | | |
|---|---|---|---|
| 5,078,252 | 1/1992 | Furuya et al. | 194/318 |
| 5,191,957 | 3/1993 | Hayes | 194/318 |
| 5,353,906 | 10/1994 | Takamisawa | 194/319 |

FOREIGN PATENT DOCUMENTS

| | | | |
|---|---|---|---|
| 2146184 | 3/1973 | Germany . | |
| 2916123 | 10/1980 | Germany | 194/319 |
| 8-16941 | 2/1996 | Japan . | |
| 2207270 | 1/1989 | United Kingdom . | |

*Primary Examiner*—F. J. Bartuska

*Attorney, Agent, or Firm*—Philip J. Anderson; Quirk & Tratos

[57] ABSTRACT

A device and method are set forth for determining the authenticity of a coin or token which includes a housing defining a passageway to pass the coin to be tested. Coils are disposed about the housing to generate magnetic flux lines at the passageway. Detection circuits detect changes in amplitudes of the frequencies generating the flux and signals are created corresponding thereto. These signals are compared at a processor to stored data corresponding to amplitude changes for an authentic coin to determine if the coin is authentic.

12 Claims, 5 Drawing Sheets

DEVICE AND METHOD FOR DISCRIMINATING A CIRCULAR PLATE BODY SUCH AS A COIN

FIELD OF THE INVENTION

The present invention is related to devices and methods for verifying the authenticity of a circular plate body such as a coin or token to be accepted, for example, by a vending machine, video game or the like.

BACKGROUND OF THE INVENTION

Electrical devices for verifying the authenticity of a circular plate body such as a coin using changes in magnetic flux generated by a coil are known in the prior art. For example, there is a coin sorting device described in the specification of Japanese patent application no. 7-46088. This device has a passage to pass one coin with coils arranged at each side of the passage and connected in series. Two other coil means are arranged at each side of the passage and are connected in parallel. Means are provided to oscillate, at a low frequency, the circuits energizing the coils which are serially connected and to oscillate the other coils at a high frequency. A problem with this system is that the inserted coin must move a base in the passage which represents a standard surface. This alignment requirement reduces the speed and accuracy at which the authenticity of the coin or token can be tested.

It is an object of the present invention to overcome the problems noted above with the prior art. Specifically, it is an object of the present invention to improve the speed at which the authenticity of the coin or token can be tested and to devise a simple structure which allows the coin to fall or roll naturally.

SUMMARY OF THE INVENTION

Toward this end, there is, therefore, set forth a device for verifying the authenticity of a circular plate body such as a coin or token which includes a housing having a passage to pass a circular plate body falling therethrough. A first coil is disposed about the housing and is energized by a first oscillating circuit at a pre-selected amplitude and frequency to generate a first magnetic flux, the lines of which pass through the passage. Second and third coils are each disposed at one side of the housing and are energized by a second oscillating circuit to serially energize the second and third coils at an amplitude and frequency to generate a second magnetic flux, the lines of which pass through the passage. The body when falling through the passage crosses the magnetic flux lines. Preferably, the magnetic flux lines generated by the first coil is normal to the ones generated by the second and third coils. Means are provided for detecting the oscillation amplitudes of the first and second circuits in response to the passage of the body through the passage and for generating first and second signals in response thereto. A processor has a memory structure storing data corresponding to the first and second signals for an authentic body. The first oscillating circuit is adapted to test for the cross section and composition of the coin. The second and third coils are adapted to test for coin diameter. The processor receives the first and second signals and compares them to the stored data representing the first and second signals for an authentic body and if a concordance exists verifies the authenticity of the body.

To increase the accuracy of the device, a second set of first, second and third coils may be disposed at another location in the passage to provide a degree of redundancy. In further embodiment, a fourth coil may be disposed about the housing and energized by a third oscillating circuit to generate magnetic flux lines through the passage. Means are provided for detecting the oscillation amplitude of the third circuit and for generating third signals in response thereto. The processor's memory structure has data stored therein corresponding to the third signal for an authentic body, the processor again adapted to compare the third signal to the stored data to verify the authenticity of the body. The third coil is adapted to test for the material of the coin.

In still a further embodiment of the present invention, fifth and sixth coils are disposed about the housing surrounding cores directed toward the passage. A fourth oscillating circuit is adapted to energize, serially, the fifth and sixth coils to generate magnetic flux lines through the passage to further test for coin composition. Means are provided for detecting the oscillation amplitudes of the fourth circuit in response to the passage of the coin and generating a fourth signal in response thereto. The processor includes in the memory structure data corresponding to the fourth signal for an authentic body, the processor adapted to compare the fourth signal received by the detecting means to the stored data to verify the authenticity of the coin.

The various oscillation circuits are adapted to oscillate the coils at different frequencies to test for the dimensional and material composition of the coin.

BRIEF DESCRIPTION OF THE DRAWINGS

These and other features and advantages will become better appreciated as the same becomes better understood with reference to the specification, claims and drawings wherein:

DESCRIPTION

Figure 1A:
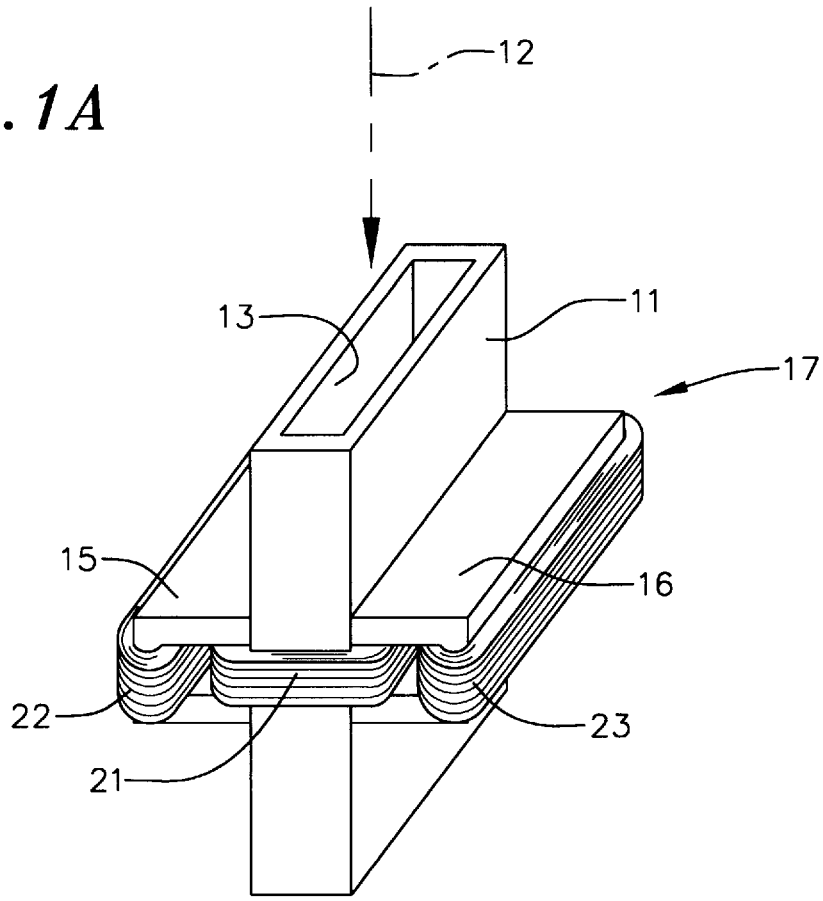
FIG. 1A is a perspective view showing one embodiment of the present invention.

Turning to the drawings, FIG. 1A shows a device 17 according to one embodiment of the present invention. The device 17 has a rectangular housing 11 having a corresponding rectangular passage 13 therethrough to pass the circular disk body which may be a coin or token and will hereinafter be referred to as a coin. It is to be understood that the circular disk body could be a token or any like object. The housing 11 and passage 13 are arranged to allow the coin to freely pass therethrough. Accordingly, the passage 13 may be vertical to allow the coin 12 (FIG. 1B) to freely fall therethrough or may be somewhat inclined. The housing 11 is preferably made from a non-magnetic material such as a synthetic resin, plastic, rubber or wood.

Figure 1B:
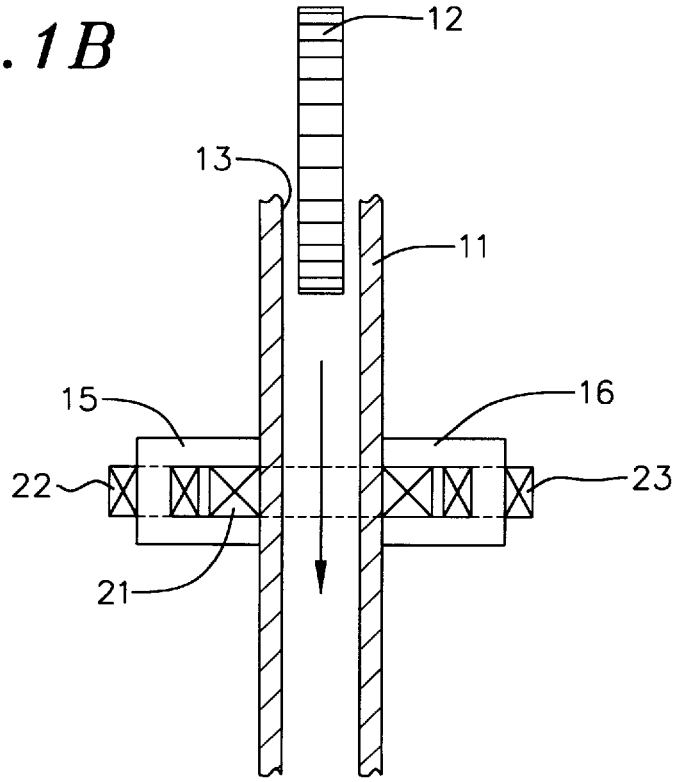
FIG. 1B is a partial section view of the device of FIG. 1.

Disposed about the housing 11 is a first coil 21 wrapped about the housing in the manner shown and more particularly wrapped about the passage 13. At each side of the first coil 21 are first and second cores 15, 16 which in cross section are U-shaped as best shown in FIG. 1B. The first and second cores 15, 16 are made from a ferrite material such as iron or steel. Wrapped about the first and second cores 15, 16 as shown in FIGS. 1A, 1B are second and third coils, 22, 23. The first and second cores 15, 16 are secured to the outside of the housing 11 as by an adhesive or the like.

FIG. 1B shows the arrangement of the first, second and third coils, 21, 22, 23 disposed about the housing 11 and its passage 13.

Figure 2A:
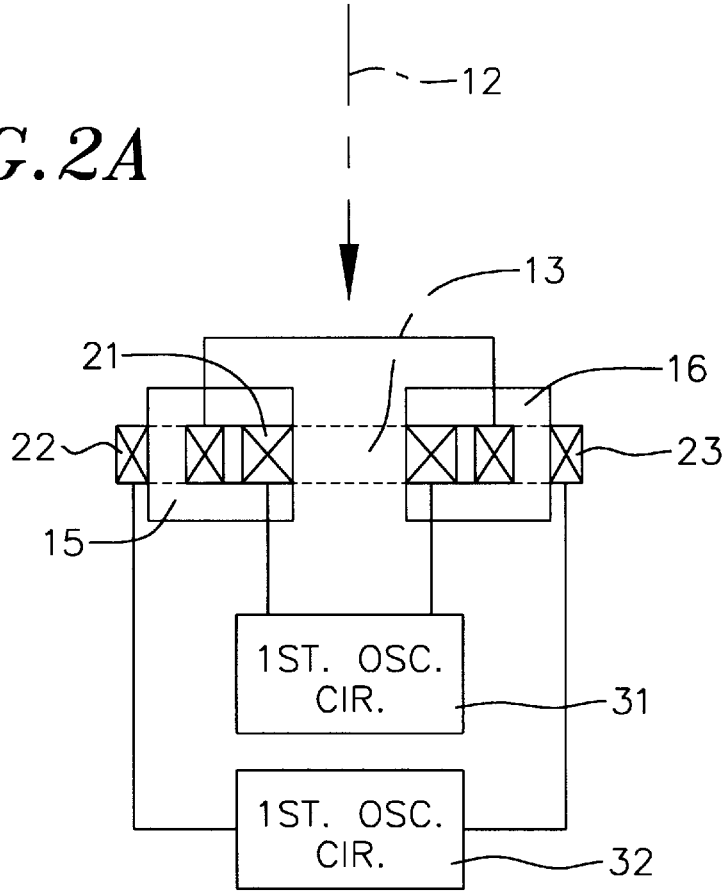
FIG. 2A is a diagram of the connection between the first, second and third coils of the embodiment of FIGS. 1A and 1B.
Figure 2B:
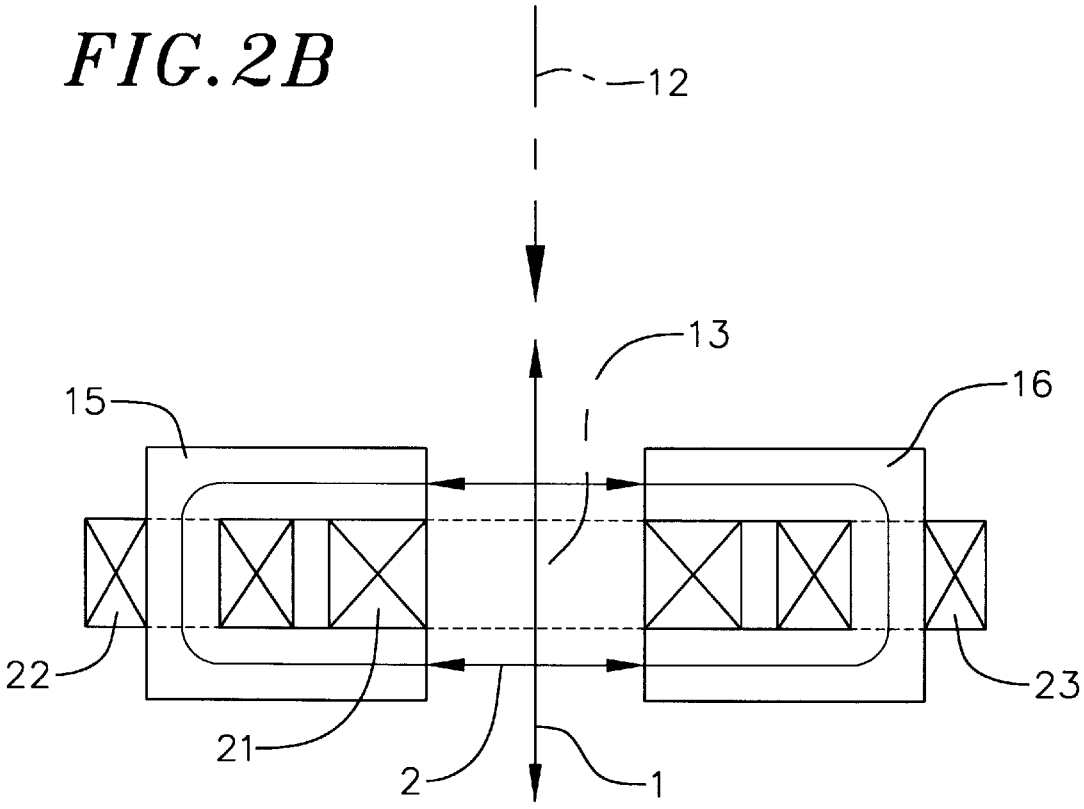
FIG. 2B is an illustration showing the lines of flux of the device of FIG. 1.

With reference to FIGS. 2A, 2B, the first coil 21 is connected to a first oscillation circuit 31 adapted to energize the first coil 21 at a pre-selected frequency and amplitude. The second and third coils 22, 23 are connected in series with a second oscillation circuit 32 adapted to energize the second and third coils 22, 23 at a second, pre-selected frequency and amplitude. The first and second oscillation circuits 31, 32 may be energized at the same or different frequencies and amplitudes. It is to be understood that the energizing of the first, second and third coils 21, 22, 23 induces the coils to produce magnetic flux in the passage 13. With reference to FIG. 2B, the first coil 21 generates a first magnetic flux 1 in the passage 13 whereas the second and third coils 22, 23 generate second magnetic flux lines 2 through the passage. Preferably, the first and second magnetic flux lines 1, 2 extend in the passage normal to one another, with the first magnetic flux 1 creating lines in the direction of the coin 12 passing through the passage 13 with the second magnetic flux 2 along lines normal to the first magnetic flux crossing through the passage 13.

Figure 3:
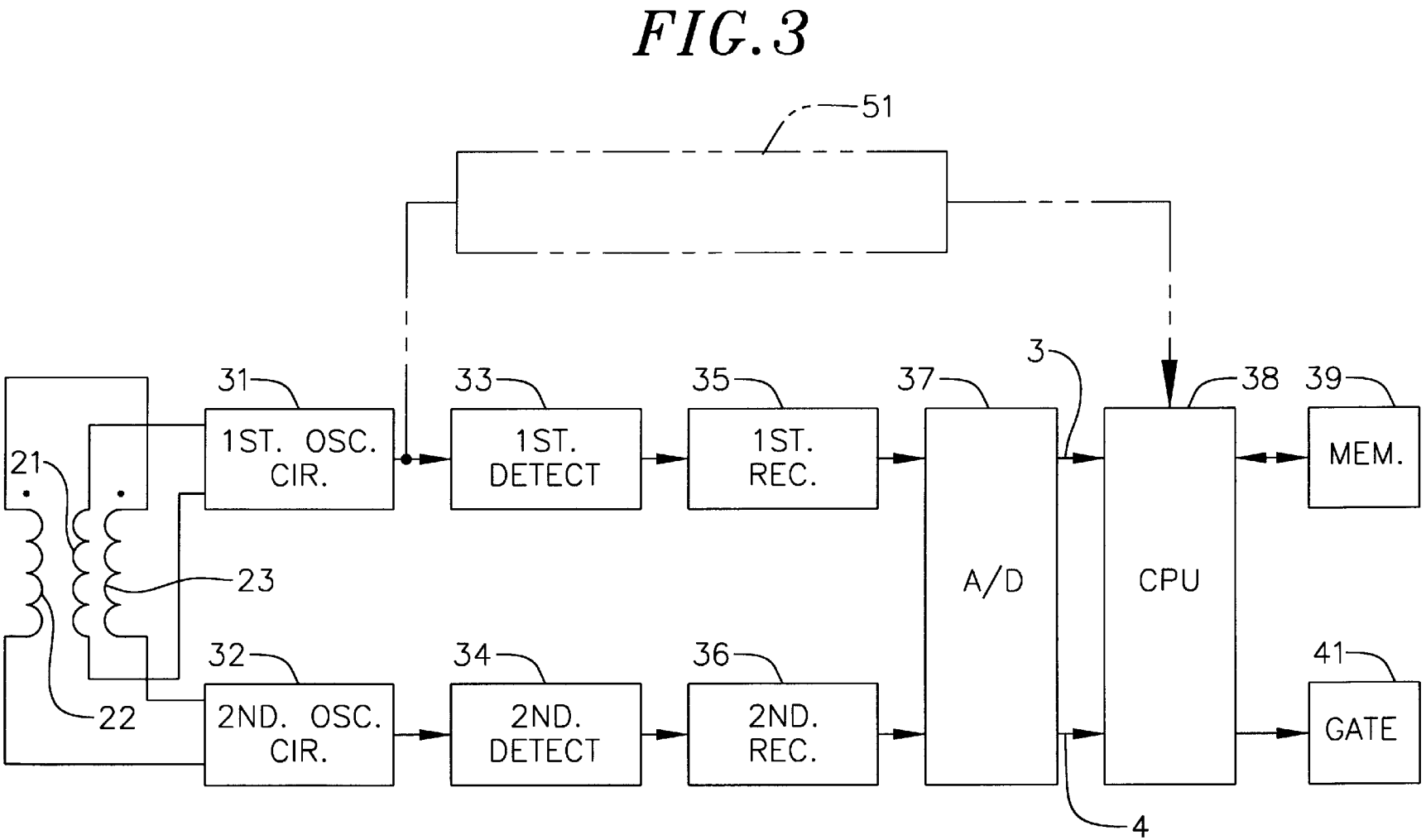
FIG. 3 is a circuit diagram of the device of FIG. 1.

With reference to FIG. 3, a first detection circuit 33 is connected to the first oscillation circuit 31 and is adapted to detect changes in the amplitude of the frequency generated by the first oscillating circuit 31 and to generate signals corresponding thereto. The signals generated by the first detection circuit 33 are issued to a first rectification circuit 35 which are, in turn, supplied to an analog to digital converter circuit 37. The converter 37 in turn issues a data signal 3 to a CPU 38 having a data structure or memory 39 storing data of the type hereinafter described.

In a like manner, the second oscillating circuit 32 is connected to a second detection circuit 34 which is adapted to detect changes in amplitude of the energy energizing the second and third coils 22, 23 and issues signals corresponding to that amplitude to a second rectification circuit 36 and thereafter to the analog to digital converter 37. A second data signal 4 corresponding to the signals generated by the second detection circuit 34 is issued by the analog to digital converter 37 to the CPU 38.

With continuing reference to FIG. 3, the CPU 38 also controls a gate 41 which can be opened and closed to direct a tested, and determined authentic coin to a bin or hopper or the like and to reject a determined unauthentic or counterfeit coin.

With reference to FIGS. 1B, 2B and FIG. 3 the operation of the device 17 will now be described. When the coin 12 passes through the passage 13 the amplitude of the energy frequency generated by the first oscillating circuit 31 is changed as is the amplitude of the second oscillating circuit relating to the second and third coils 22, 23. The first and second detection circuits 33, 34 generate signals corresponding to the change in amplitude, those signals sent through the respective first and second rectification circuits 35, 36 which are in turn supplied to the analog to digital converter 37. From the converter 37, the first and second data signals 3, 4 corresponding to the changes in amplitude detected by the first and second detection circuits are issued to the CPU 38. The CPU 38 compares the first and second data signals 3, 4 to data stored in the memory 39 which corresponds to amplitude signals corresponding to authentic coins. If a correspondence is determined, the CPU 38 controls the gate 41 to open to pass the determined authentic coin 12. If a counterfeit or unauthentic coin is detected, the gate 41 is closed and the coin may be directed to a return slot or the like.

The first data signal 3 relating to the first detection circuit 33 and thereby the first coil 21 and first oscillation circuit 31 relates primarily to the cross section area of the coin 12 and secondarily relates to the material of the coin 12. Therefore, the first detection circuit 33 tests for coin 12 cross section area and to some degree the material of the coin 12. The second detection circuit 34 relating to the second and third coils 22, 23 relates primarily to the diameter of the coin 12 and secondarily relates to the material of the coin 12. Therefore, the second detection circuit 34 is adapted to compare primarily and secondarily the diameter of the coin 12 and material of the coin 12 to the data stored in the memory 39.

The aforementioned testing of the coin cross section area, diameter and material in the manner described above occurs while the coin is freely passing through the passage 13.

With reference to FIG. 3, it is to be understood that two sets of first, second and third coils 21–23 along with their related circuitry may be used to provide a degree of redundancy for comparing the aspects of the coin 12 as it falls through the passage 13. Detection circuits of the type described above issue signals which are converted and sent to the CPU 38 for comparison to data stored in the memory 39 corresponding to an authentic coin 13.

Figure 4A:
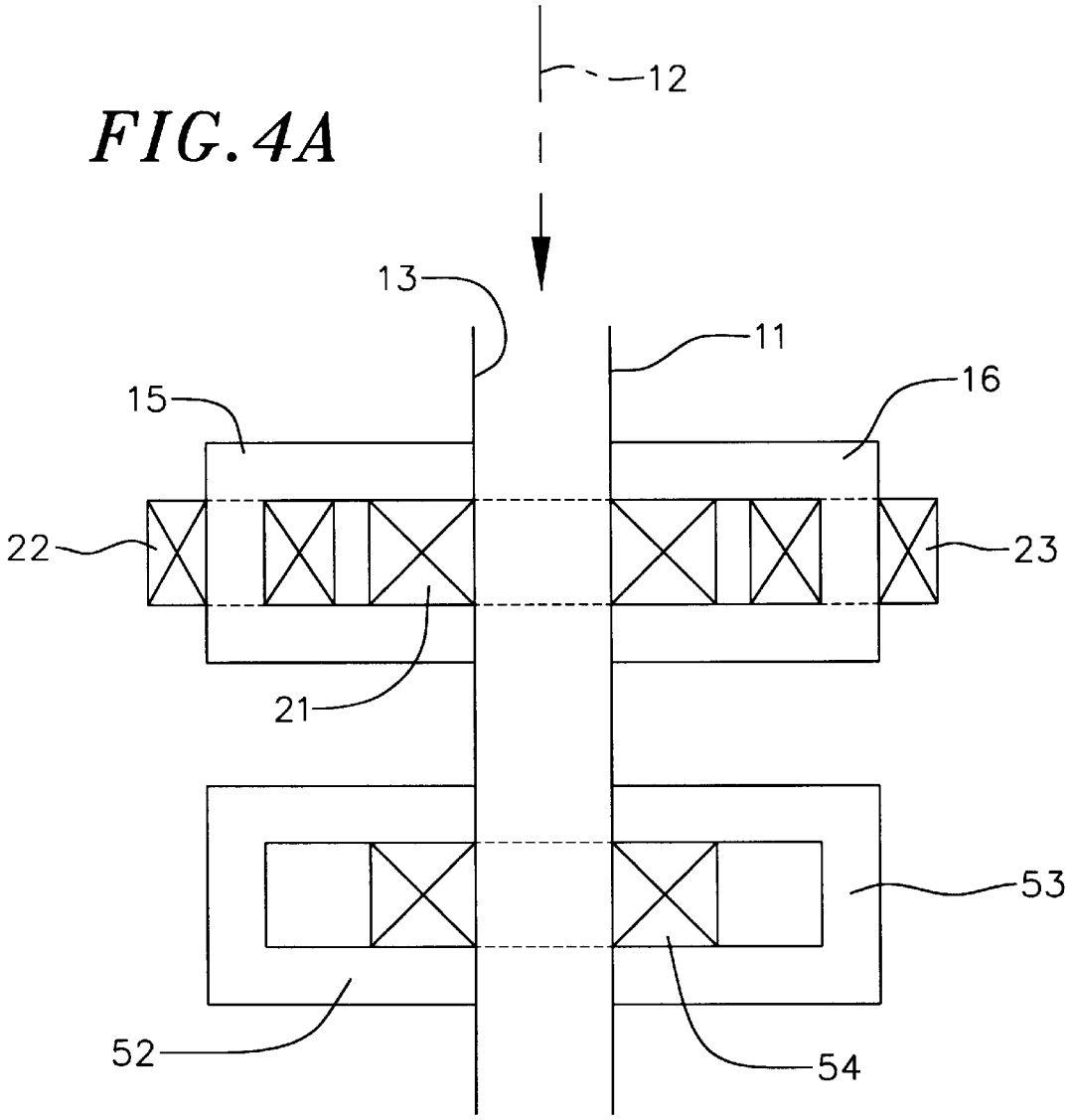
FIG. 4A is an illustration of yet another embodiment of the present invention.
Figure 4B:
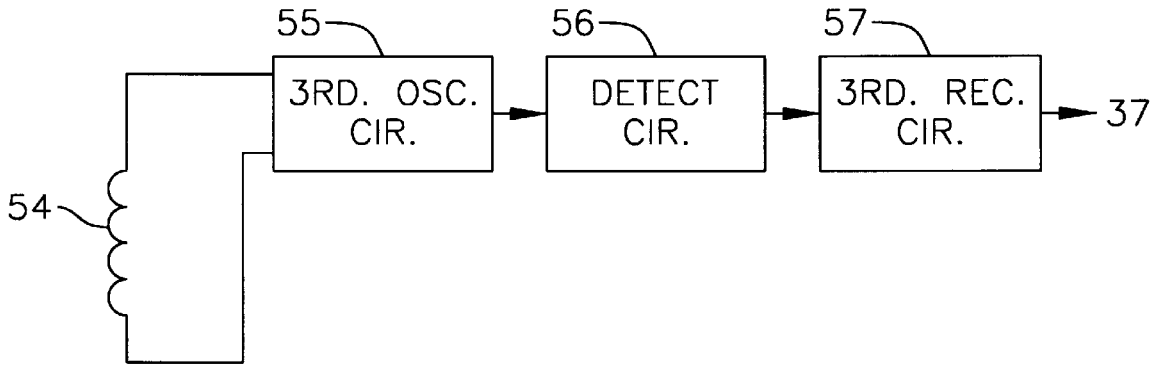
FIG. 4B is a partial circuit diagram of the device of FIG. 4A.

Turning to FIG. 4, yet a further embodiment of the device 17 is illustrated. According to this embodiment, a fourth coil 54 is disposed about the housing 11 beneath third and fourth cores 52, 53 which, like the first and second cores 15, 16 described above, may be U-shaped in cross section and fashioned from a ferrite material. The fourth coil 54 is energized at a selected amplitude and frequency by a third oscillating circuit 55 as shown in FIG. 4B. A third detection circuit 56 detects the amplitude of the energy used to energize the fourth coil 54 and issue signals corresponding thereto. A third rectification circuit 57 rectifies the signal from the third detection circuit 56 and sends it to the analog to digital converter 37. From the converter 37 a third data signal (not shown) is sent to the CPU 38 for comparison to data stored in the memory 39. Preferably the third oscillation circuit 55 generates a frequency which is lower than that generated by the first and second oscillation circuits 31, 32.

When a coin 12 falls through the passage 13 the amplitude of the oscillations of the third oscillation circuit 55 are changed, that change detected by the third detection circuit 55 resulting in data signals issued to the CPU 38 which are compared to that stored in the memory corresponding to an authentic coin 12. Preferably the third data signals coming from the third detection circuit 56 relate primarily to the material of the coin 12.

Figure 5A:
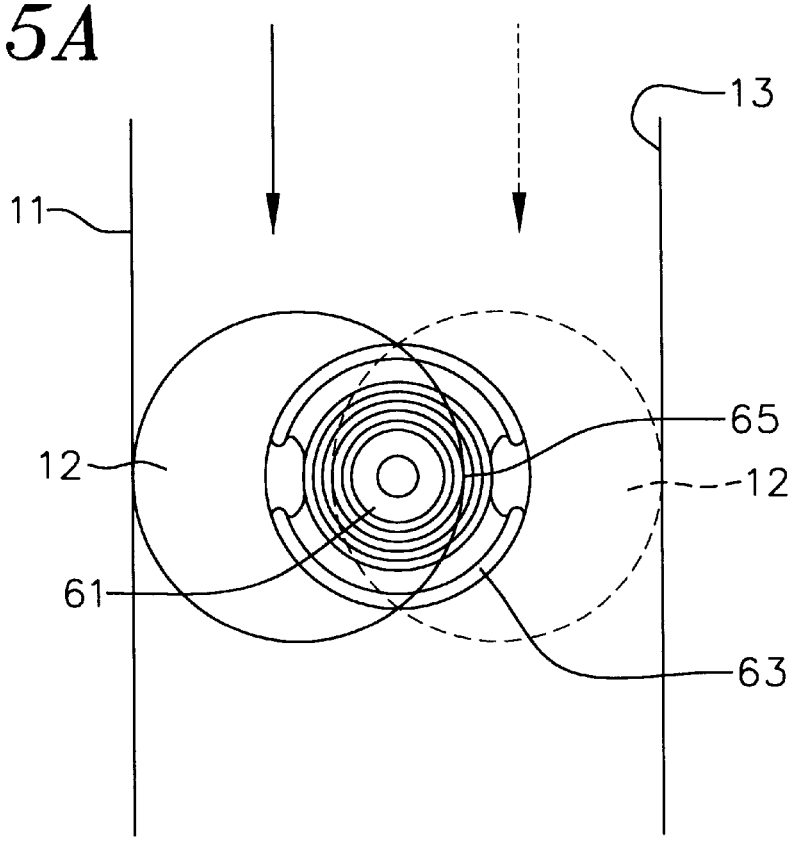
FIG. 5A illustrates yet another embodiment of the present invention.
Figure 5B:
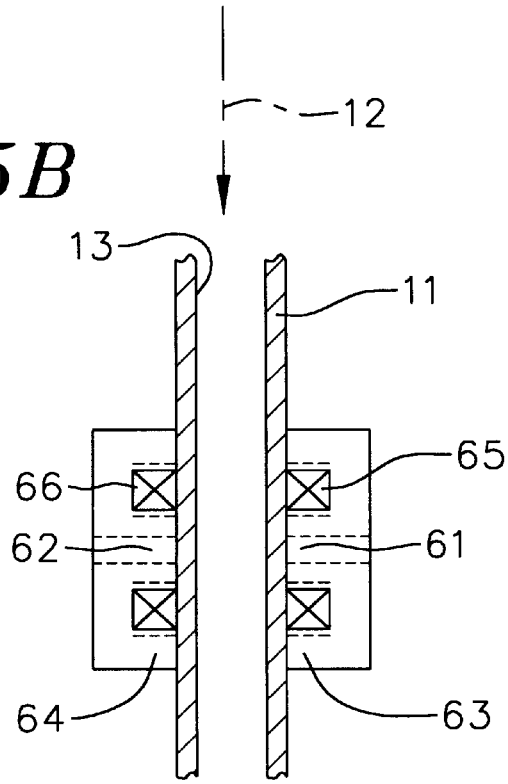
FIG. 5B is a section view of the embodiment of FIG. 5A.

Turning to FIGS. 5A, B yet another embodiment of the present invention is shown. In this embodiment fifth and sixth coils 65, 66 are disposed at the outside of the housing 11 to span the passageway 13. Each of the fifth and sixth coils are wrapped about circular third and fourth cores 61, 62 which are in turn directed toward the passageway 13. First and second covers, 63, 64 encase the fifth and sixth coils and their fourth and fifth cores 61, 62.

Each of the fifth and sixth coils 65, 66 are connected in series to a fourth oscillation circuit (not shown) which in turn, like the embodiments described above, is connected to a fourth detection circuit, fourth rectification circuit to generate signals corresponding to the amplitude of the oscillations generated in the fifth and sixth coils and converted by the analog converters 37 to issue data signals to the processor 38. Preferably, the frequency of the oscillations generated by the fourth oscillation circuit energizing the fifth and sixth coils 65, 66 is at a frequency lower than that generated by the first and second oscillation circuits 31, 32. The data signals generated by the fourth detection circuit corresponding to the frequencies of the fifth and sixth coils relates generally to the material of the coin 12.

Accordingly, the coin 12 falling through the passage 13 is tested by the various magnetic fluxes generated by the coils described above which generate data signals corresponding to the amplitudes of the frequency energy generated by the coils, those data signals compared to data signals stored in the memory 39 for an authentic and genuine coin.

While I have described certain embodiments of the present invention, it is to be understood that it is subject to many modifications without departing from the spirit and scope of the appended claims.

I claim:

1. A device for verifying a circular plate body comprising:

a housing including a passage to pass a body falling in a direction therethrough;

a first coil wrapped about the housing;

a first oscillating circuit to energize the first coil to generate a first magnetic flux through said passage;

first and second cores covering the first coil at each side of the passage;

second and third coils wrapped about said first and second cores about axes parallel to said direction;

a second oscillating circuit to energize the second and third coils to generate a second magnetic flux through said passage crossing said first magnetic flux, said body when falling through said passage crossing said magnetic fluxes;

means for detecting the oscillation amplitudes of said first and second circuits in response to passage of the body through said passage and generating first and second signals in response thereto; and a processor including a memory structure storing data corresponding to said first and second signals for an authentic body, said processor adapted to compare said first and second signals to said stored data to verify the authenticity of the body.

2. The device of claim 1 wherein the first and second magnetic fluxes intersect substantially normally in said passage.

3. The device of claim 1 wherein said housing is non-magnetic.

4. The device of claim 1 further including, a fourth coil disposed about the housing, a third oscillating circuit to energize the fourth coil to generate a magnetic flux through said passage, means for detecting the oscillation amplitude of said third circuit in response to passage of the body through said passage and generating a third signals in response thereto, said processor including a memory structure storing data corresponding to said third signal for an authentic body, said processor adapted to compare said third signal to said stored data to verify the authenticity of the body.

5. The device of claim 1 further including, fifth and sixth coils, each disposed at one side of the housing and each disposed about a core directed toward the passage, a fourth oscillating circuit to energize the fifth and sixth coils to generate a magnetic flux through said passage, means for detecting the oscillation amplitude of said fourth circuit in response to passage of the body through said passage and generating a fourth signal in response thereto, said processor including a memory structure storing data corresponding to said fourth signal for an authentic body, said processor adapted to compare said fourth signal to said stored data to verify the authenticity of the body.

6. A method for testing the authenticity of a coin or token comprising:

providing a housing having a passage to pass a coin falling in a direction therethrough;

imposing a first magnetic flux through the passage by energizing a first coil wrapped about the passage with energy at a selected frequency and amplitude by a first oscillating circuit;

imposing a second magnetic flux through said passage crossing the first magnetic flux by energizing second and third coils wrapped about first and second cores disposed at either side of the first coil about axes which are substantially parallel to said direction with energy at a selected frequency and amplitude by a second oscillating circuit;

detecting the oscillation amplitudes of said first, second and third coils and generating first and second signals corresponding thereto; and comparing the first and second signals with data stored at a processor corresponding to first and second signals corresponding to an authentic coin or token.

7. The method of claim 6 further including routing a determined authentic coin or token to a collection receptacle therefor.

8. A device for discriminating a circular plate body by detecting changes in amplitude of energy used to generate magnetic fluxes comprising:

a housing defining a passage to pass a body moving in a direction therethrough;

a first coil wound around the housing and passage;

first and second cores covering the first coil at either side of the housing;

second and third coils wrapped about the first and second cores respectively in a direction parallel to said direction;

means for energizing the first, second and third coils to impose crossing magnetic fluxes in the passage and for detecting changes in the amplitude of said energizing means.

9. The device of claim 8 wherein the magnetic flux for the first coil is substantially orthogonal to the flux of the second and third coils.

10. The device of claim 8 wherein the first and second cores are elongate and extend for substantially the width of a side wall of the housing.

11. The device of claim 8 further including a fourth coil wound around the housing above or below the first coil and means for energizing the fourth coil to impose a magnetic flux in the passage and for detecting changes in the amplitude of said fourth coil energizing means.

12. The device of claim 11 further including fifth and sixth coils disposed to either side of the housing and means for energizing the fifth and sixth coils to impose magnetic fluxes in the passage and for detecting changes in the amplitude of said fifth and sixth coil energizing means.

* * * * *